US010476196B2

(12) United States Patent
Venaleck

(10) Patent No.: US 10,476,196 B2
(45) Date of Patent: Nov. 12, 2019

(54) ELECTRICAL CONNECTOR WITH CONTACTS HOLDING SPRING-LOADED PINS

(71) Applicant: Ohio Associated Enterprises, LLC, Painesville, OH (US)

(72) Inventor: John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 15/907,770

(22) Filed: Feb. 28, 2018

(65) Prior Publication Data

US 2019/0267747 A1 Aug. 29, 2019

(51) Int. Cl.

| | |
|---|---|
| ***H01R 13/514*** | (2006.01) |
| ***H01R 13/405*** | (2006.01) |
| ***H01R 43/16*** | (2006.01) |
| ***H01R 13/6597*** | (2011.01) |
| ***H01R 13/08*** | (2006.01) |
| ***H01R 43/24*** | (2006.01) |
| ***H01R 13/58*** | (2006.01) |
| ***H01R 13/6586*** | (2011.01) |
| *H01R 13/62* | (2006.01) |

(52) U.S. Cl.

CPC ..... *H01R 13/514* (2013.01); *H01R 13/08* (2013.01); *H01R 13/405* (2013.01); *H01R 13/5845* (2013.01); *H01R 13/6586* (2013.01); *H01R 13/6597* (2013.01); *H01R 43/16* (2013.01); *H01R 43/24* (2013.01); *H01R 13/62* (2013.01)

(58) Field of Classification Search

CPC .... H01R 13/514; H01R 13/08; H01R 13/405; H01R 13/5845; H01R 13/6586; H01R 13/6597; H01R 43/16; H01R 43/43; H01R 43/24; H01R 13/62; H01R 11/18; H01R 9/0506; H01R 12/00; H01R 13/6592

USPC ..... 439/606, 700, 701, 579, 497, 607.06, 439/607.41, 607.44, 885

See application file for complete search history.

(56) References Cited

U.S. PATENT DOCUMENTS 5,194,020 A * 3/1993 Voltz ..... H01R 13/514 439/540.1
5,241,135 A * 8/1993 Fetzer ..... H01R 9/0512 174/88 R
5,385,490 A * 1/1995 Demeter ..... H01R 9/038 439/289

(Continued)

*Primary Examiner* — Travis S Chambers
(74) *Attorney, Agent, or Firm* — Renner, Otto, Boisselle & Sklar, LLP

(57) ABSTRACT

An electrical connector is made up of a series of stacked headers. The headers may all be made from similar contact arrays initially held together by carriers, with the contact arrays and the carriers stamped from a single piece of sheet metal. After the stamping a header body is overmolded onto the contacts of a header. For some of the headers the carrier is then separated from all of the contacts, and is removed. For other of the headers the carrier remains secured to some of the contacts, while being separated from other of the contacts. The retained carrier functions to electrically connect together all of the contacts that remain secured to it, for example for use as a common ground. The contacts may have beams or clips, bent portions that are used for receiving spring-loaded pins.

9 Claims, 4 Drawing Sheets

(56) References Cited

U.S. PATENT DOCUMENTS

| | | | | |
|---|---|---|---|---|
| 5,993,242 | A * | 11/1999 | Zell | H01R 4/2429 439/394 |
| 6,316,954 | B1 | 11/2001 | Venaleck et al. | |
| 6,428,344 | B1 * | 8/2002 | Reed | H01R 9/05 439/455 |
| 6,524,135 | B1 * | 2/2003 | Feldman | H01R 9/035 439/607.46 |
| 6,674,297 | B1 | 1/2004 | Florence, Jr. et al. | |
| 6,902,416 | B2 * | 6/2005 | Feldman | G01R 1/06772 324/755.01 |
| 6,939,174 | B2 * | 9/2005 | Wu | H01R 13/514 439/607.05 |
| 7,559,806 | B2 * | 7/2009 | Lin | H01R 13/2421 439/289 |
| 7,740,508 | B2 * | 6/2010 | Feldman | G01R 31/2889 324/755.02 |

* cited by examiner

ELECTRICAL CONNECTOR WITH CONTACTS HOLDING SPRING-LOADED PINS

FIELD OF THE INVENTION

The invention is in the field of electrical connectors for electrical testing, such as by using spring-loaded pins.

DESCRIPTION OF THE RELATED ART

In the field of electrical test and measurement, a commonly used device is a spring-loaded pin, often referred to as a "pogo pin," for probing an electrical site. These pins are a spring-loaded probe usually held in a sleeve that is press fitted to a dielectric housing. The sleeves will normally have a slight "banana" bend to promote a press fit in the housing and also to ensure good electric contact to the pogo pin when inserted. The spring-loaded pin is easily replaced when necessary while the sleeve remains in the housing. It is common for the sleeves to be soldered to wires emanating from the back of the housing. The sleeves can also be bussed together to form common grounds. Each pin site is handled individually, comprising either press fitting a sleeve, soldering a wire to the sleeve after the sleeve is inserted in the housing, or bussing several sleeves together for common ground or common current carriers.

Spring-loaded pins are expensive and the cost of the sleeve is approximately one-third to one-half the cost of the spring-loaded (pogo) pin.

SUMMARY OF THE INVENTION

A header for a connector has contacts that are selectively severed from a carrier that is initially attached to all of the contacts, to program the header to selectively allow electrical coupling of some of contacts, through the header.

Electrical contacts each have one or more pairs of elastic beams for receiving spring-loaded pins.

According to an aspect of the invention, an electrical connector includes: stacked headers that are mechanically coupled together, wherein each of the headers includes: a series of contacts each having clamps for receiving and securing a spring-loaded contact pin; and a dielectric header body coupled to the contacts, maintaining spacing between the contacts. For each of a first type of the headers, the header includes a carrier attached to some, but not all, of the contacts, with the carrier and the contacts stamped from a single piece of metal, such that the carrier makes an electrical connection between the some of the contacts. For a second type of the headers, the contacts are all electrically isolated from one another within the connector.

According to an embodiment of any paragraph(s) of this summary, the header may have contact positions designed to accommodate different wire types and sizes.

According to an embodiment of any paragraph(s) of this summary, the electrical connector further including wires.

According to an embodiment of any paragraph(s) of this summary, for the first type of the headers, the wires are coaxial wires with a central conductor, and a shield conductor surrounding the central conductor.

According to an embodiment of any paragraph(s) of this summary, for the second type of the headers, the wires are single-conductor wires.

According to an embodiment of any paragraph(s) of this summary, for each of the first type of the headers, the shield conductors are electrically attached to the carrier, and the central conductors are electrically attached to respective of the contacts that are not attached to the carrier.

According to an embodiment of any paragraph(s) of this summary, the coaxial wires are located in saddles in the carriers of the first type of the headers.

According to an embodiment of any paragraph(s) of this summary, each of the headers includes an overmolded strain relief that secures the wires.

According to an embodiment of any paragraph(s) of this summary, for the first type of the headers the overmolded strain relief encloses the carrier.

According to an embodiment of any paragraph(s) of this summary, the central conductors and the signal wires are welded to the contacts through slots in the header bodies of the first type of the headers.

According to an embodiment of any paragraph(s) of this summary, for each of the contacts the clamp for receiving and securing a spring-loaded contact pin includes two pairs of elastic beams, with the contact pin to be secured between each of the pairs of elastic beams.

According to an embodiment of any paragraph(s) of this summary, the connector further includes a housing that receives the stacked headers.

According to another aspect of the invention, a method of making an electrical connector includes: producing a first header of the electrical connector; and stacking the first header with a second header of the electrical connector. The producing of the first header includes: overmolding a header body onto a contact array that includes a series of electrical contacts held together by a carrier; after the overmolding, severing connections between the carrier and some, but not all, of the contacts; and after the severing, attaching the wires, either by welding of soldering, then overmolding a strain relief onto the contact array, with the strain relief covering the carrier and the wires.

According to an embodiment of any paragraph(s) of this summary, the method further includes forming the contact array and the carrier by stamping out of a single piece of metal.

According to an embodiment of any paragraph(s) of this summary, the method further includes, prior to the stacking, producing the second header. The producing the second header includes: overmolding a second header header body onto a second header contact array that includes a series of second header electrical contacts held together by a second header carrier; after the overmolding, severing connections between the second header carrier and all of the second header contacts, and removing the second header carrier; and after the severing, overmolding a second header strain relief onto the contact array.

According to an embodiment of any paragraph(s) of this summary, the severing the connections includes severing every second of the connections, along a width of the contact array.

According to an embodiment of any paragraph(s) of this summary, the method further includes, for the first header, coupling wires to the carrier and to the contacts for which the connections with the carrier have been severed.

According to an embodiment of any paragraph(s) of this summary, the wires are coaxial wires; and the coupling includes: attaching central conductors of the coaxial wires to the contacts for which the connections with the carrier have been severed, through slots in the header body; and attaching shield conductors of the coaxial wires to the carrier.

According to an embodiment of any paragraph(s) of this summary, the method further includes, prior to the coupling, forming saddles in the carrier for receiving the coaxial wires. The attaching of the shield conductors to the carrier occurs at the saddles.

According to an embodiment of any paragraph(s) of this summary, the method further includes coupling single-conductor wires to the second header through slots in the second header body.

According to an embodiment of any paragraph(s) of this summary, the contacts each have pairs of elastic beams; and the method further includes securing spring-loaded contact pins to respective of the contacts, using the elastic beams.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

An electrical connector is made up of a series of stacked headers. The headers may all be made from similar contact arrays initially held together by carriers, with the contact arrays and the carriers stamped from a single piece of sheet metal. After the stamping a header body is overmolded onto the contacts of a header. For some of the headers the carrier is then separated from all of the contacts, and is removed. For other of the headers the carrier remains secured to some of the contacts, while being separated from other of the contacts. The retained carrier functions to electrically connect together all of the contacts that remain secured to it, for example for use as a common ground. The contacts may have beams or clips, bent portions that are used for receiving spring-loaded pins. The headers with the carrier severed and removed may have wires coupled to each of the contacts. The headers may have co-axial (coax) wires coupled to the carrier and the contacts, for example with central single wires of the coax wires to the contacts, and annular shield conductors of the coax wires to the carrier. Multiple of the different types of headers may be stacked together, with the different types of the headers alternating with one another, with the resulting electrical connector used to engage a set of conductive pads, for example as part of a testing process for testing a device.

Figure 1:
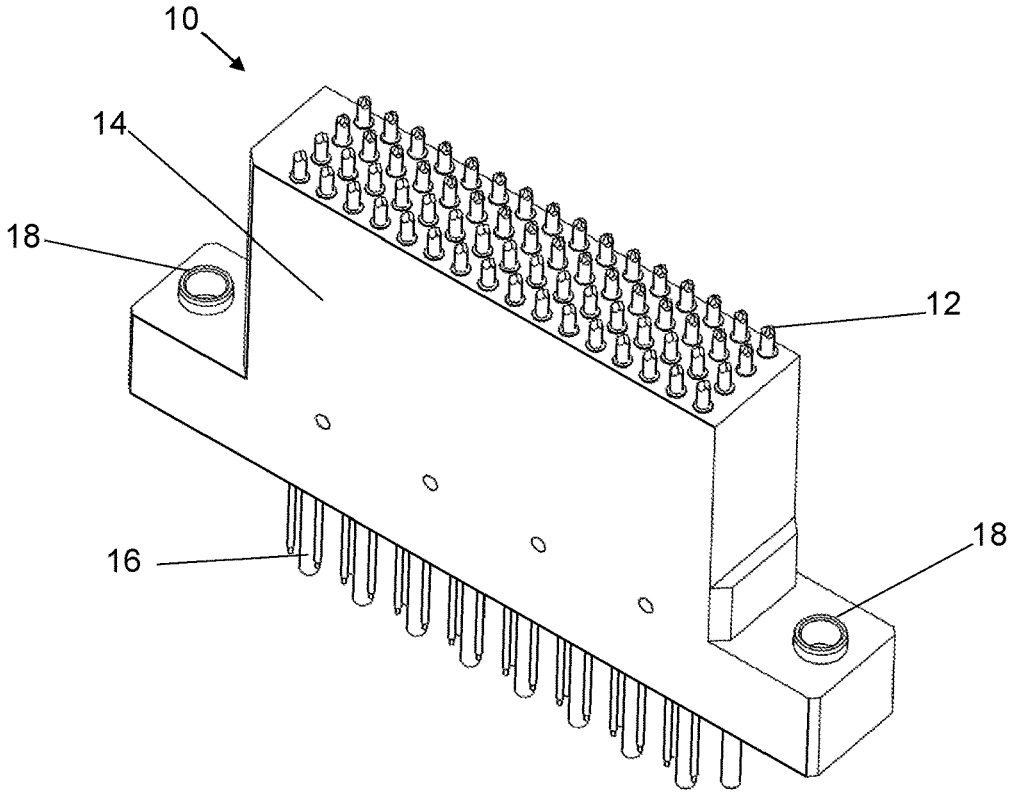
FIG. 1 is an oblique view of an electrical connector according to an embodiment of the invention.

FIG. 1 shows an electrical connector 10 in which a series of spring-loaded contact pins 12 emerges from a housing 14. The spring-loaded pins 12 may be of a sort that are commonly-known as POGO pins, with inner members spring biased to extend out beyond an outer cylindrical member. The housing 14 may be made from a suitable plastic, for example being molded. A series of wires 16 emanate from the back of the housing 14, and are electrically coupled to the spring-loaded pins 12 within the housing 14, as is described below. The housing 14 may have a pair of threaded inserts 18, which may be used to mechanically couple the connector 10 to a device (not shown), such as a testing device for testing circuit boards or other electronic equipment. In such a testing device the ends of the pins 12 are pressed against conductive pads of the device to be tested (not shown). This is just one example of the type of device that the connector 10 may be a part of, and many other used for connectors with spring-loaded pins are possible.

Figure 2:
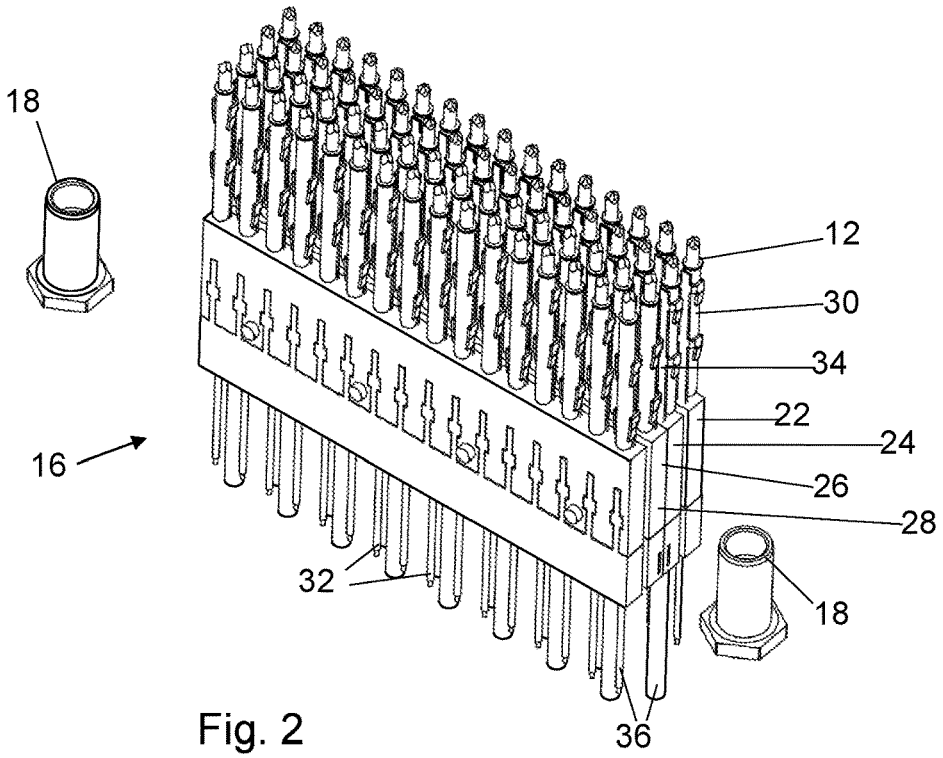
FIG. 2 is an oblique view of the electrical connector of FIG. 1, with the housing of the connector removed for illustration purposes.

With reference now to FIG. 2, the connector 10 includes a series of stacked headers 22, 24, 26, and 28 within the housing 14 (FIG. 1). The headers in the stack are of two types, a first type (headers 24 and 26) in which contacts 34 are coupled to coaxial wires 36, and a second type (headers 22 and 28) in which contacts 30 are coupled to single-conductor wires 32. Headers can also be designed to accommodate a combination of wire types and sizes. The contacts 30 and 34 also secure the array of spring-loaded pins 12 that are parts of both types of the headers 22-28. The headers 24 and 26 face one another within the housing 14.

A feature of the connectors 10 is that the arrays of contacts 30 and 34 have the same initial contact arrangement, with connections to a carrier either partially or fully severed. This is described below in the greater detail, in the process of describing the steps for manufacturing the headers 22-28.

Figure 3:
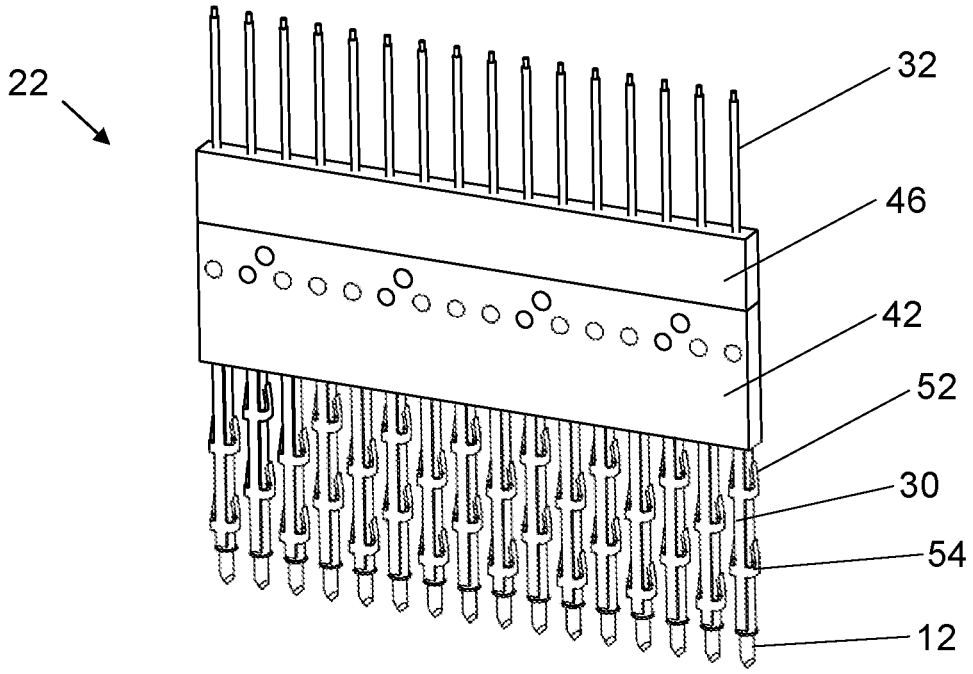
FIG. 3 is an oblique view of one of the headers of the electrical connector of FIG. 1. This view shows all positions with single conductor wires.

FIG. 3 shows further details of the header 22. The header 22 has a header body 42 that is secured to the contacts 30 while the contacts 30 are still mechanically coupled together by a pair of common carriers, which are removed after the header body 42 is overmolded onto the contacts 30. The header body 42 maintains the contacts 30 in a desired spatial relationship to one another, for example being evenly spaced apart. The header body 42 may also have provisions to allow for the wires 32 to be secured and electrically coupled to respective of the contacts 30. After the wires 32 are coupled to the contacts 30, a strain relief 46 is overmolded onto the wires 32 and the header body 42. The strain relief 46 protects the connections between the contacts 30 and the wires 32 from damage by external forces, such as pulling on the wires 32.

The header body 42 and the strain relief 46 may be made of a suitable thermoplastic material, for example. The connections between the wires 32 and the contacts 30 may be made by soldering or welding.

The contacts 30 each have two pairs of clamp legs (elastic gripping beams) 52 and 54 for receiving and securing the spring-loaded pins 12. The clamp legs 52 and 54 are stamped and folded from the same piece of material (sheet metal, such as copper) used to produce the contacts 30. The pairs 52 and 54 are staggered in location along the contacts 30 for adjacent of the contacts 30. The ends of the clamp legs or beams of each pair are folded in toward each other, and resiliently deform outward to grip and hold the pins 12. Besides mechanically securing the spring-loaded pins 12, the clamp legs 52 and 54 aid in making an electrical connection between the pins 12 and their respective contacts 30.

Figure 4:
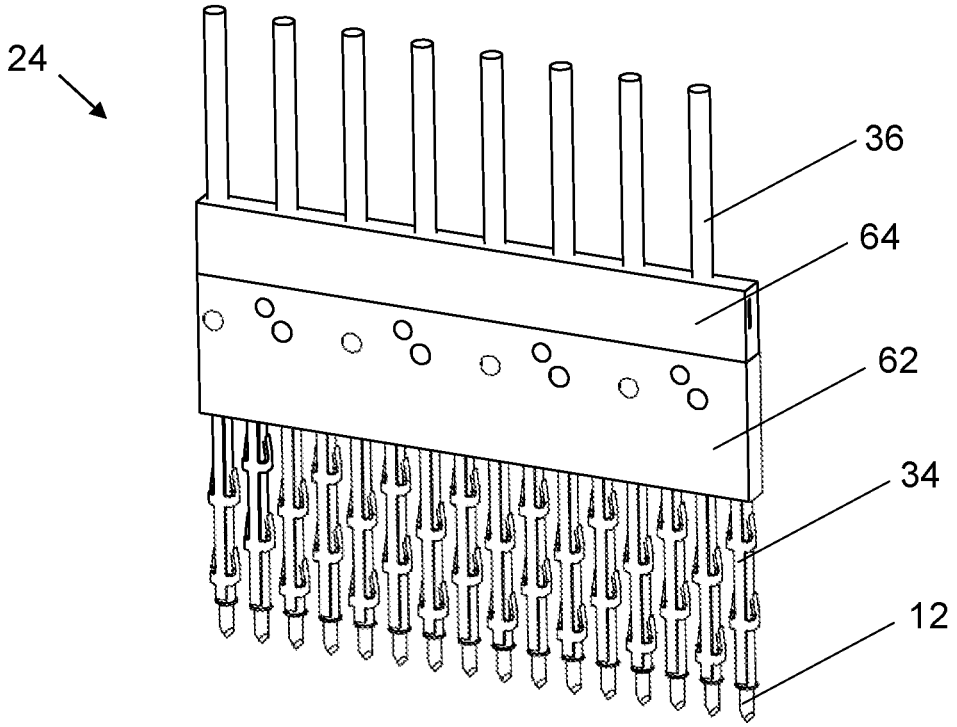
FIG. 4 is an oblique view of another of the headers of the electrical connector of FIG. 1. This view shows every other position with co-axial wires, preserving half the positions for common grounds.

FIG. 4 shows further details of the header 24. Half of the contacts 34 are electrically connected to central (signal) conductors of the coax wires 36. These connections are made in slots within a header body 62, as explained further below. The other half of the contacts 34 are all electrically connected together, such as with all of these contacts 34 being grounded. Individual of these two groups of contacts 34 alternate with one another across a width of the header 24. The half of the contacts 34 that are electrically connected together all remain connected to carrier that is attached to all of these contacts. This carrier is embedded within a strain relief 64, so is not visible in FIG. 4. The outer conductors of the coax wires 36, which may act as shield conductors, are electrically coupled to the carrier, as explained further below.

The contacts 34 also have clamp legs for receiving the spring-loaded pins 12. These clamp legs on the contacts 34 are similar to the clamp legs 52 and 54 (FIG. 3) of the contacts 30 (FIG. 3).

Figure 5:
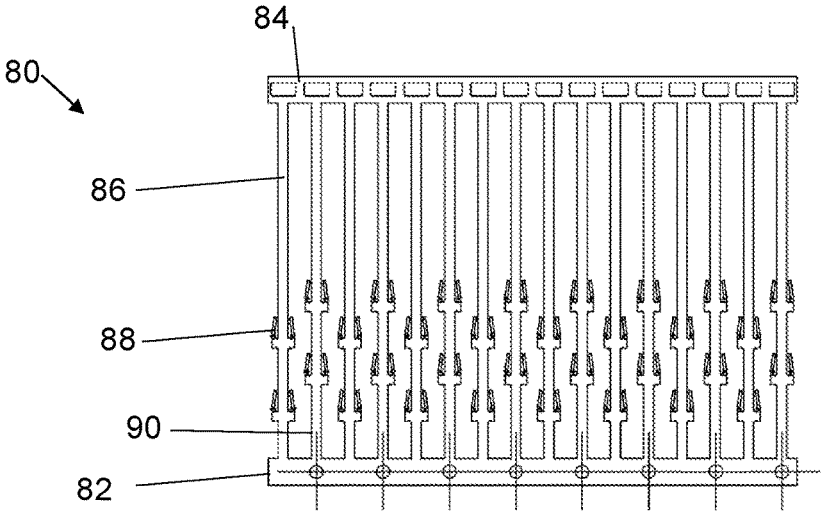
FIG. 5 is a plan view of a contact array used in manufacturing the headers of FIGS. 3 and 4.
Figure 6:
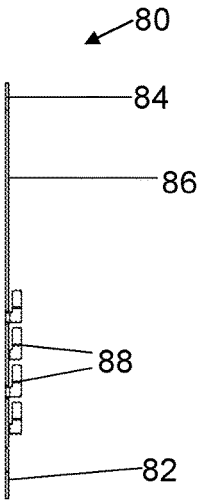
FIG. 6 is a side view of the contact array of FIG. 5.

FIGS. 5 and 6 show a stamped part 80 that is used for the contacts for either of the types of the headers 22-28 (FIG. 2). The part has a pair of carriers 82 and 84 on either end, with contact legs 86 between the carriers 82 and 84. The carriers 82 and 84 are retained coupled to the legs through at least most of the manufacturing process (such as during at least some of the insert molding) to allow good alignment and to maintain geometric integrity. The contact legs 86 each have pairs of clamp legs 88, the elastic beams described earlier for securing the spring-loaded pins 12.

Figure 7:
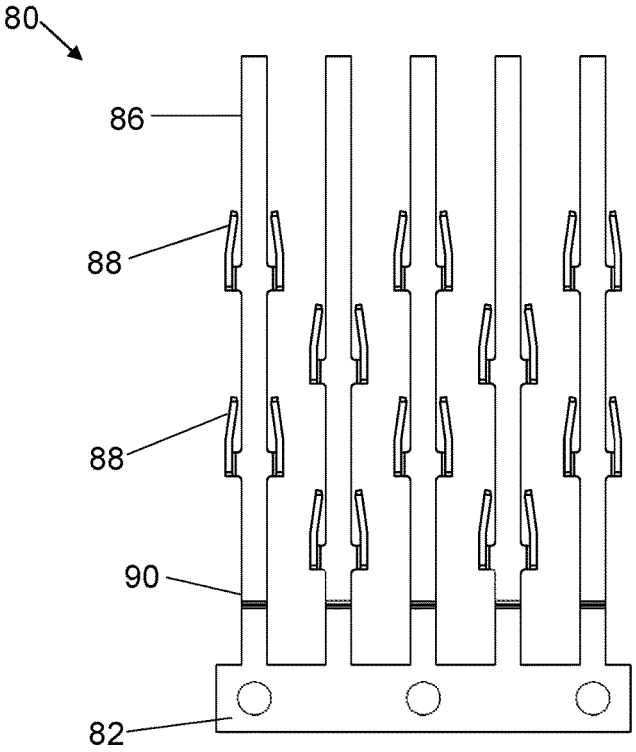
FIG. 7 is a plan view of part of the contact array of FIG. 5.

With reference now in addition to FIG. 7, the carrier 82 is configured to be separated from the legs 86 after the overmolding of a header body (either the header body 42 (FIG. 3) or the header body 62 (FIG. 4)) onto the legs (contacts) 86. The carrier 82 is configured to be removed by using a break-off feature, breaking off the carrier at boundaries 90 between the carrier 82 and the legs 86. The break-off feature 90 may be weakened portions of the stamped part 80 that make separation easier and accomplished at specified locations along the legs 86. The carrier 82 makes handling of the stamped part 80 easier during the manufacturing process, and also protects the otherwise fragile stamped part 80 until installation in the housing.

The carrier 84 either may be fully removed as part of the header fabrication process, as in for the header 22 (FIG. 3), or may be retained in place, with some of the connections between the legs 86 and the carrier 84 severed, as in for the header 24 (FIG. 4). These different configurations are now described in turn.

Figure 8:
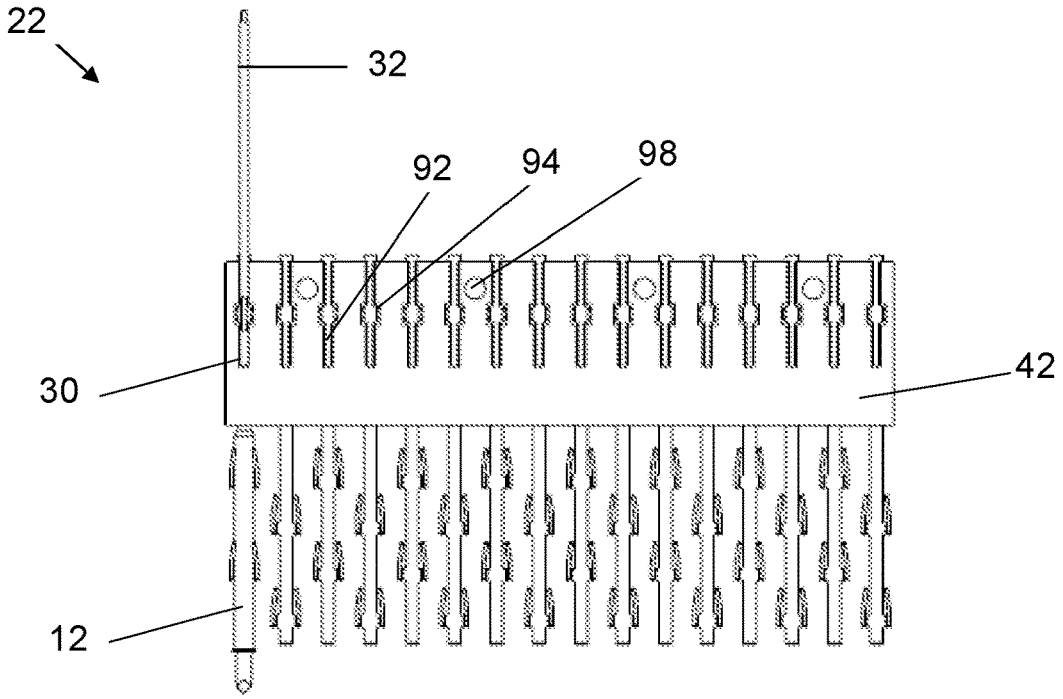
FIG. 8 is a plan view showing the wire connection in the header of FIG. 3.

FIG. 8 shows the connection made of a wire 32 and one of the contacts 30, as parts of the header 22. The connection is made in one of a series of slots 92 in the header body 42 that leave open portions of the contacts 30. The wires 32 are placed into the slots 92 and are welded to the contacts 30 at weld sites 94, where the slots 92 are wider. Insulation on the wires 32 in the vicinity of the weld sites 94 is stripped prior to the insertion of the ends of the wires 32 into the slots 92. The header body 42 also has a series of holes 98 that are for receiving pins that retain the header 22 in the housing 14 (FIG. 1).

Figure 9:
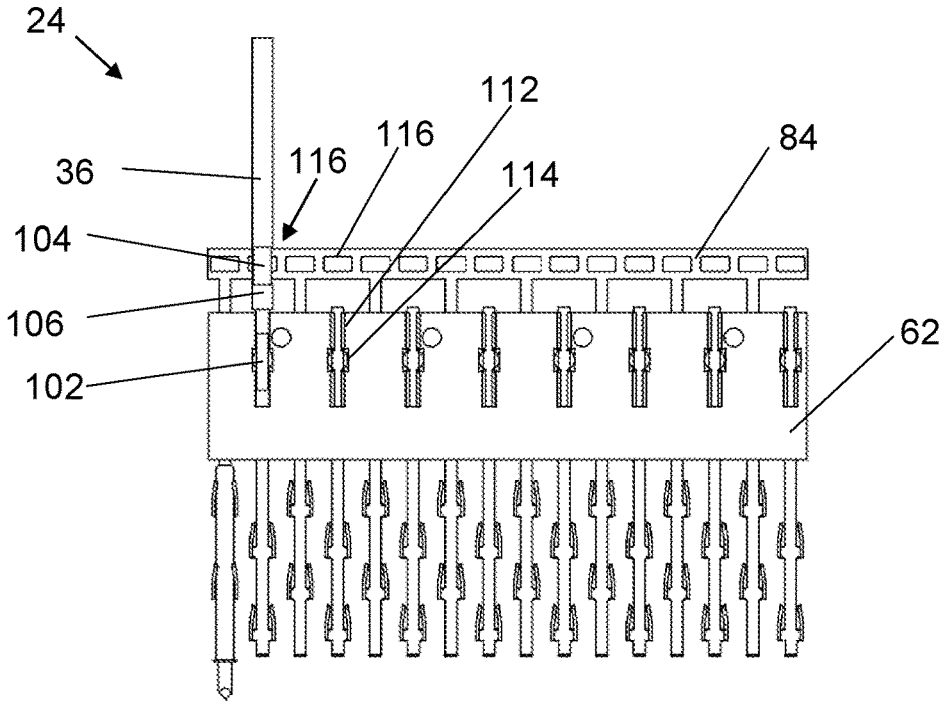
FIG. 9 is a plan view showing the co-axial wire connection in the header of FIG. 4.

FIG. 9 shows the connections made in the header 24. The coax wires 36 are prepared to expose portions of a central conductor 102, and of a shield conductor 104 and that surrounds the central conductor 102. Internal insulation 106, between the central conductor 102 and the shield conductor 104, is maintained to keep the central conductor 102 and the shield conductor 104 electrically isolated from one another. The central conductors 102 are inserted into slots 112 in the header body 62, and then are welded to the contacts 34 at weld sites 114.

The shields 104 are soldered (or otherwise electrically coupled) to the carrier 84. The coax wires 36 rest in saddles 116 formed in the carrier 84, curved depressions that are configured to receive the coax wires 36. Electrical connections are maintained between the carrier 84 and those of the contacts 34 that have not been severed from the carrier 84. The other of the contacts 34 have had their connections with the carrier 84 severed, for example by a suitable cutting process. After the connection of the coax wires to the carrier 84 and to the contacts 34, the strain relief 64 (FIG. 4) is overmolded onto the header 24, to encase the carrier 84 and to protect it.

The connector 10 (FIG. 1) shown and described above is one of many possible configurations. The specific embodiment shown is a four-row array, with each array have sixteen spring-loaded pins, for a total of 64 of the spring-loaded pins 12 (FIG. 1), with connections to 32 of the wires 32 (FIG. 3) and sixteen of the coax wires 36 (FIG. 4). However many other configurations are possible. The use of the carrier 84 (FIG. 5) allows the header to be selectively programmed, with some of the contacts electrically connected to one another, while other of the contacts are electrically isolated from one another within the header. Different headers within the same connector may have different arrangements.

There are many possible advantages for the connector and the fabrication method described above. The elastic beams on the contacts eliminate the need for sleeves to receive the spring-loaded pins. Such spring-loaded pins may be easily replaced in such contacts. The connector and fabrication allows step and repeat termination. There is an elimination of the need to solder wires to individual sleeves to achieve ground bussing. Two-dimensional termination of a linear contact array is enabled. The configuration allows headers to be installed in the dielectric housing, each carrying a multiplicity of pogo sites instead of installing the sleeve sites one at a time. The housing advantageously has the headers held in place with plastic pins, with such pins being removable for replacement or repair.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector comprising:

stacked headers that are mechanically coupled together, wherein each of the headers includes:

a series of contacts each having clamps for receiving and securing a spring-loaded contact pin; and a dielectric header body coupled to the contacts, maintaining spacing between the contacts;

wherein, for each of a first type of the headers, the header includes a carrier attached to some, but not all, of the contacts, with the carrier and the contacts stamped from a single piece of metal, such that the carrier makes an electrical connection between the some of the contacts; and wherein for a second type of the headers, the contacts are all electrically isolated from one another within the connector.

2. The electrical connector of claim 1, wherein for each of the contacts the clamp for receiving and securing a spring-loaded contact pin includes two pairs of elastic beams, with the spring-loaded contact pin to be secured between each of the pairs of elastic beams.

3. The electrical connector of claim 1, further comprising a housing that receives the stacked headers.

4. The electrical connector of claim 1, further comprising wires;

wherein for the first type of the headers, the wires are coaxial wires with a central conductor, and a shield conductor surrounding the central conductor; and wherein for the second type of the headers, the wires are single-conductor wires.

5. The electrical connector of claim 4, wherein the central conductors and the wires are welded to the contacts through slots in the header bodies of the first type of the headers.

6. The electrical connector of claim 4, wherein for each of the first type of the headers, the shield conductors are electrically attached to the carrier, and the central conductors are electrically attached to respective of the contacts that are not attached to the carrier.

7. The electrical connector of claim 6, wherein the coaxial wires are located in saddles in the carriers of the first type of the headers.

8. The electrical connector of claim 4, wherein each of the headers includes an overmolded strain relief that secures the wires.

9. The electrical connector of claim 8, wherein for the first type of the headers the overmolded strain relief encloses the carrier.

* * * * *